US005545256A

United States Patent [19]

Fukuda et al.

[11] Patent Number: 5,545,256

[45] Date of Patent: Aug. 13, 1996

[54] COATING APPARATUS

[75] Inventors: Kazuhiro Fukuda; Atsushi Saito, both of Hino, Japan

[73] Assignee: Konica Corporation, Tokyo, Japan

[21] Appl. No.: 321,313

[22] Filed: Oct. 11, 1994

[30] Foreign Application Priority Data

Oct. 15, 1993 [JP] Japan ..... 5-258394

[51] Int. Cl.[6] ..... B05C 3/12

[52] U.S. Cl. ..... 118/410; 118/419

[58] Field of Search ..... 118/410, 411, 118/419; 425/461

[56] References Cited

U.S. PATENT DOCUMENTS 2,681,294 6/1954 Bequin .

3,005,440 10/1961 Padday .

5,336,322 8/1994 Tobisawe ..... 118/410

FOREIGN PATENT DOCUMENTS 2-207865 8/1990 Japan .

*Primary Examiner*—Brenda A. Lamb

*Attorney, Agent, or Firm*—Finnegan, Henderson, Farabow, Garrett & Dunner, L.L.P.

[57] ABSTRACT

A coating head includes slit wall members forming a slit therebetween. A surface of the wall members corresponding in position to an exit portion of the slit is finished so as to have a center line mean roughness not larger than 0.1 μm.

4 Claims, 5 Drawing Sheets

COATING APPARATUS

BACKGROUND OF THE INVENTION

The present invention relates to a coating apparatus having a coating liquid supplying slit, for example, a slide bead coater, curtain coater, or extrusion coater, and more particularly to a coating apparatus in which occurrence of coating streak defects is greatly reduced.

In many cases, coating troubles, specifically streak defects occur along the length of a long roll of web material. Accordingly, it greatly influences the quality or the production yield. Recently, technology of a multi-layer simultaneous processing method has been developed for the manufacture of silver halide photographic sensitive material in which many thin layers are required, wherein multi-layer means a plurality of layers.

For these multi-layer simultaneous coating methods, a coating apparatus such as a slide hopper, curtain coater, or extrusion coater is preferable. However, a problem of streak defects tend to occur in the use of such coating apparatus.

Streak defects are caused by various factors. Primary factors of the streak defects are: the disturbance of beads; the invasion of foreign matter; or the deposit of foreign matter to a portion of the coating apparatus.

These defects possibly occur in a mono-layer. However, specifically in a coating solution layer such as color sensitive material, when a portion of a color layer is scratched for some reason, streak-like thin layer portions are formed. When different color layers are simultaneously coated on an upper layer of the above-described portions, a difference of concentration occurs, and visibly appears as streak defects, resulting in a considerable problem.

Conventionally, a coating bridge, formed between the end of a coater lip and a web, so-called disturbance of beads is mainly responsible for the above-described defects. In order to solve the above-described defects, many methods including the following are proposed: the pressure reduction method disclosed in U.S. Pat. No. 2,681,294 and its improvement; the improvement of the process at the time of passage on joints disclosed in Japanese Patent Publication No. 4371/1973; considerations of the type of a lip and a slide surface angle disclosed in Japanese Patent Publication No. 39980/1976; the improvement of the surface roughness of the lip surface disclosed in Japanese Patent Publication Open to Public Inspection No. 207865/1990; and other methods and improvements.

Further, regarding the shape of a slit, the technology for providing a cutout-step portion, and further for providing an enlarged portion or cutout in the slit is disclosed in U.S. Pat. No. 3,005,440 or Japanese Patent Publication Open to Public Inspection 328174/1992 filed by the present by inventors.

However, the causes of streak defects are not limited to the above-described problems, and these defects have not been yet solved.

SUMMARY OF THE INVENTION

With respect to the above-described problems, an object of the present invention is to provide a coating apparatus in which the adherence of cohesive materials or foreign materials in a slit and a cutout portion is repressed, and which can prevent for long periods the streak defects caused by the adherence of cohesive materials, etc.

The above-described problems of the present invention can be solved by an apparatus for coating a web with a coating solution, wherein the apparatus comprises a supply section to supply the coating solution to a coating head; and the coating head includes slit wall members forming a slit therebetween, the slit is provided with an exit through which the coating solution is fed to the web, and wherein a surface of the wall members corresponding in position to the exit portion of the slit is finished so as to have a center line mean roughness not larger than 0.1 μm.

Describing in detail, a grinding portion or a ground portion having a center line mean roughness not larger than 0.1 μm is provided on a surface of the slit wall members in the vicinity of the slit exit portion in the coating apparatus.

It is preferable that a finished length of the ground portion from a slide surface or a lip surface at the exit portion of the slit is not less than 1 mm. In the case that a cut-out portion is provided to the exit portion of the slit, it is preferable that the finished length of the ground portion including a cut-out portion from an inside edge or a pocket side edge of the cut-out portion is not less than 1 mm.

The slit is constructed by the combination of at least two slit wall members, and the grinding can be conducted for the slit wall members on the disassembled condition by buffing or electropolishing. The grinding method is not limited to the buffing or the electropolishing.

BRIEF DESCRIPTION OF THE DRAWING

FIG. 1(*a*) is a sectional view showing an embodiment of a curtain coater for two layers.

FIG. 1(*c*) is a sectional view showing an extrusion coater for one layer.

FIG. 2(*b*) through 2(*e*) are sectional views of slits having various types of enlarged cutout portions.

DETAILED DESCRIPTION OF THE PREFERRED EMBODIMENT

An embodiment of the present invention will be specifically described below.

Figure 1:
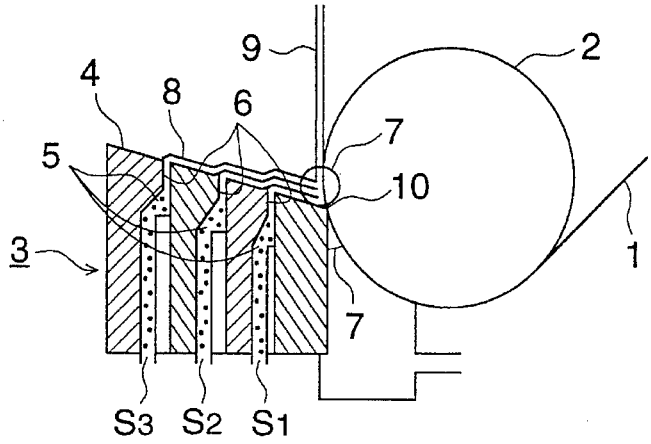
FIG. 1(*a*) is a sectional view showing an embodiment of a slide bead coating apparatus in which three layers can be simultaneoulsy coated.
Figure 1:
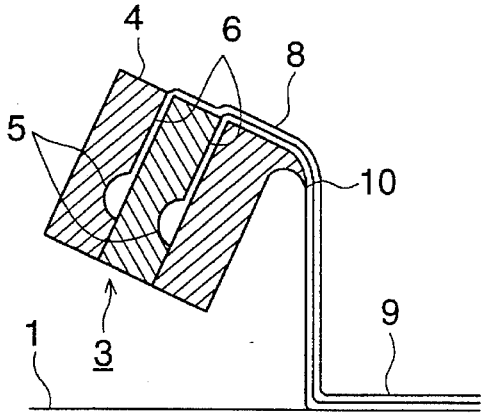
Figure 1:
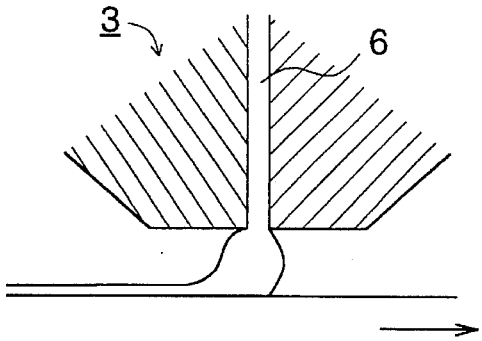

FIG. 1(*a*) is a sectional view showing an embodiment of a slide bead coating apparatus in which three layers can be simultaneously coated. In FIG. 1(*a*), a plurality of coating solutions $S_1$, $S_2$, and $S_3$ pass through pockets 5 spreading in the direction of width, and slits 6, and flow out on a slide surface 4. The coating solutions flow downward along the slide surface 4, and arrive at the leading edge of the coater (lip) 10. Then the coating solutions are coated on a web 1 which is conveyed around a back-up roller 2, through a coating bridge, which is called a bead 7.

FIG. 1(*b*) is a sectional view showing an embodiment of a curtain coater for two layers. Coating solutions which have flowed downward along the slide surface in the same way as in the slide bead coater shown in FIG. 1(*a*), flow downward from the lip 10 in the air without support, and are coated on the web 1.

FIG. 1(*c*) is a sectional view showing an extrusion coater for one layer. A coating solution is coated directly from the slit 6 onto the web.

These coating apparatus are each characterized by the slit 6 for supplying the coating solution.

Figure 2:
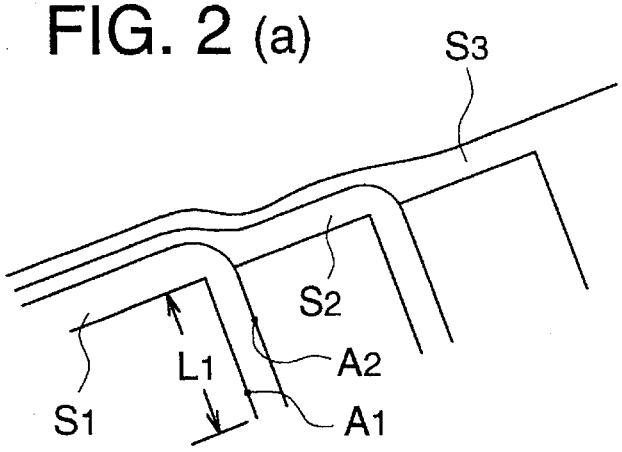
FIG. 2(*a*) is an enlarged sectional view for explaining a slit portion.
Figure 2:
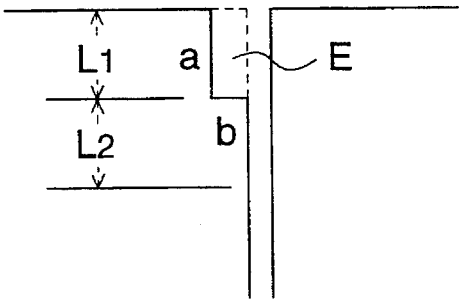
Figure 2:
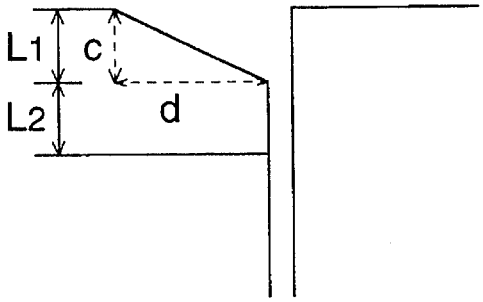
Figure 2:
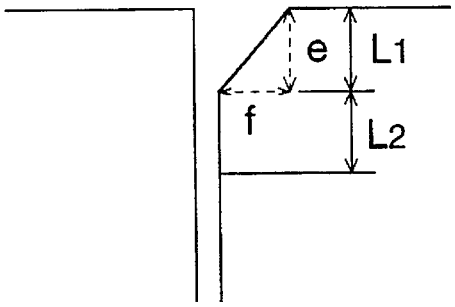
Figure 2:
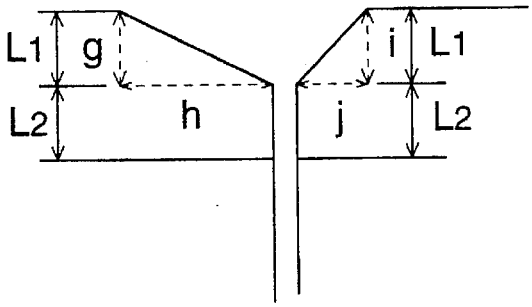

FIG. 2(*a*) is an enlarged sectional view of the vicinity of the slit. In this case, a coater having a slide surface such as in the case of the slide bead coater or the curtain coater is shown. This figure is an enlarged sectional view showing a condition in which coating solutions $S_1$, $S_2$ flowing from the slits are superimposed on the slide surface. As can clearly be seen from the figure, the coating solution in the upstream side, for example, $S_3$, flows over the coating solution $S_2$ on the downstream side, and also over $S_1$, and flows as a multi-layer.

In this case, when, for example, a coating solution such as a dispersed solution in which materials are easily precipitated, is used, and thereby, cohesive materials or foreign materials $A_1$, $A_2$ adhere to the slit for the coating solution $S_1$, then the coating solution $S_1$, is obstructed by the foreign materials and forms streak-like thin film, resulting in streak defects. Of course, streak defects can occur even in the case of a mono-layer of $S_1$. However, in the case of multi-coating as shown in this example, the coating solution $S_2$ which flows on the slide surface superimposing on the $S_1$, layer, and which generates a different color, fills the thin film portion, and more clear streak defects occur, resulting in more serious defects in the case of the color sensitive materials.

In order to prevent these streak defects, a previously described cutout portion is provided in the slit. FIGS. 2(*b*) to (*e*) are sectional views of slits having various types of cutout portions (enlarged portions). When the enlarged portion E is provided at the exit portion of the slit, the cutout portion E decreases the delivery pressure at the time when the coating solution flows from the exit of the slit onto the slide surface, and represses disturbance of the solution with respect to the upstream coating solution. FIGS. 2(*b*) through 2(*e*) show various shapes of the cutout portions.

Due to considerations by the inventors, there are some differences in the pressure distribution at the vicinity of the exit of the slit depending on the shape of the slit. When an enlarged portion is provided at the slit exit, the following are found: the pressure distribution becomes uniform, thereby the disturbance of the coating layer is repressed. Further, when the enlarged ratio is not less than 2, conspicuous effects can be obtained as follows, and further, even when the enlarged portion is provided on a coating block downstream of the slit or on the coating block upstream of the slit, or even when the enlarged portion is provided on both sides of the slit or one side of the slit, the same effects can be expected.

The flow at the exit of the slit is preferably not smaller than 0.1 cc/cm sec in all the coating layers. The gap of the slit can be arbitrarily set within the range of 50 through 1000 μm, preferably 200 through 600 μm. Normally, the depth of the slit is within the range of 30 through 50 mm.

In the present invention, the adherence of cohesive materials or foreign materials is prevented when a portion of the above-described slit surface is smoothed.

Primarily, it is preferable that the entire surface of the contact portion of the slit for the coating solution is smoothed. However, when grinding is carried out in order to smooth the surface, there are the following possibilities in that: the accuracy of the gap of the slit is lowered; thereby, the flow distribution in the direction of the width of the coating is not uniform; and unevenness of the coated surface occurs. For this reason, the limit of the slit gap was considered by the inventors so that the uniformity of the flow distribution in the direction of the width can be achieved, and the streak defects caused by the adherence of foreign matter at the slit portion can be prevented. As a result, the following was found: normally, the range of the smoothed portions is approximately 5 mm when expressed by the distance ($L_1$) on the exit side of the slit (slide surface side). In this case, when the enlarged portion E is provided in the slit as described above, the smoothed portion ($L_2$), the length of which is approximately 5 mm, is further necessary on the enlarged portion and the lower end of the enlarged portion.

The coating apparatus having a slide surface has been described above. The above-described enlarged portion is also effective for other coating apparatus having a slit for supplying a coating solution, for example, extrusion coaters.

The center line mean roughness (Ra) in the present invention is according to the method prescribed in JISB-0601.

The coating speed in the present invention is set within the range of 30 through 600 m/min. The coating speed is preferably 40 through 400 m/min, and more preferably 60 through 300 m/min.

EXAMPLES

Effects of the present invention will be specifically explained in examples below.

EXAMPLE 1

(Coating solution)

Silver halide emulsion including coupler dispersion material, surface active agent, sensitization coloring matter, etc.

Viscosity: 30 cp at 35° C. In order to clearly show the effect of the invention, the following coupler having a low dispersion stability is used. That is, the coating solution easily precipitates materials, and the materials easily adhere to the slit portions.

(A coupler dispersion solution having a low dispersion stability)

The following magenta coupler of 300 g is dissolved in ethyl acetate of 600 ml and dinonyl phenol (DNP) of 300 g, and then the solution is dispersed in 5% gelatin of 600 ml including sodium dodecylbenzene sulfonate of 15 g. After that, the coupler dispersion solution from which ethyl acetate is removed by pressure reduction is supplied to 5% gelatin aqueous solution of 14 liters including silver halide, sensitization coloring matters, etc.

Chemical 1

Magenta coupler

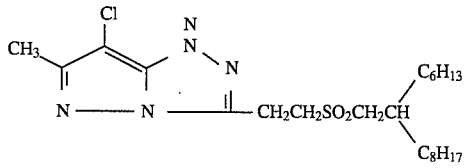

(Coating conditions)

A support: a Gel under-coated polyethylene terephthalate base, the thickness of which is 100 μm. Coating speed: 50 m/min Wet thickness of the coating layer: 60 μm (A coating apparatus)

The slide bead coating apparatus for mono-layer as shown in FIG. 1(*a*) is used. The distance $L_1$ from the slide surface shown in a slit portion in FIG. 2(*a*) is 3 mm, the center line mean roughness (Ra) is changed as shown in the following table. The surface is buffed as a smoothing method.

(Evaluation of occurrence of streak defects) Long term coating was carried out under the above-described conditions, and the period of time required for the occurrence of streak was measured.

The result of these measurements is shown in the following table and also in the graph in FIG. 3.

| Case | Ra (μm) | Time (hours) | |
|---|---|---|---|
| 1 | 0.1 | 23 | Present invention |
| 2 | 0.05 | 37 | Present invention |
| 3 | 0.03 | 48 | Present invention |
| 4 | 0.01 | 48 | Present invention |
| 5 | 0.25 | 1 | blank |
| 6 | 0.12 | 5 | comparison |

Case 5 is a case in which no grinding was carried out (blank).

From the above results, the following was found: when the surface is ground to a surface roughness of 0.1 μm, the period of time required for the occurrence of streak defects is greatly extended. Specifically, when the roughness is 0.03 μm, the streak defects did not occur for about 48 hours.

Figure 3:
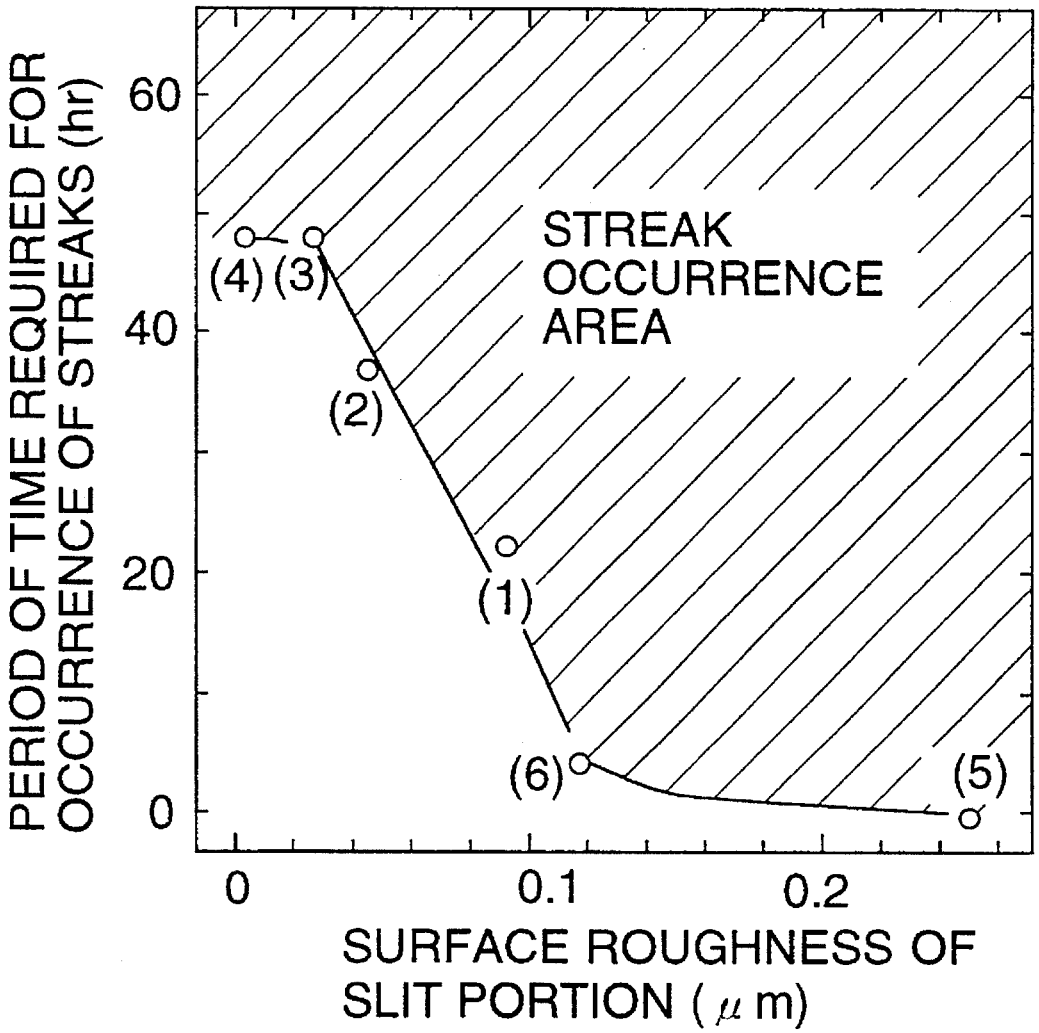
FIG. 3 is a graph showing the relationship of the surface roughness of a slit and the time in which streaks do not yet occur.

It can be seen from a graph representing above results in FIG. 3 it is preferable to make Ra not larger than 0.05 μm, and more preferable to make it not larger than 0.03 μm.

EXAMPLE 2

The coating solution composed of the same constituents as those in Example 1 is used, and the viscosity of the solution is set to 10 cp, 30 cp, and 60 cp respectively. In this example (Ra: 0.03 μm), the surface grinding distance $L_1$ was changed as follows, and this change was evaluated. In this case, 72 hours at the maximum was selected for this evaluation, and in the case in which the streak defects were not found, "no occurrence" was written in Table 1.

Figure 4:
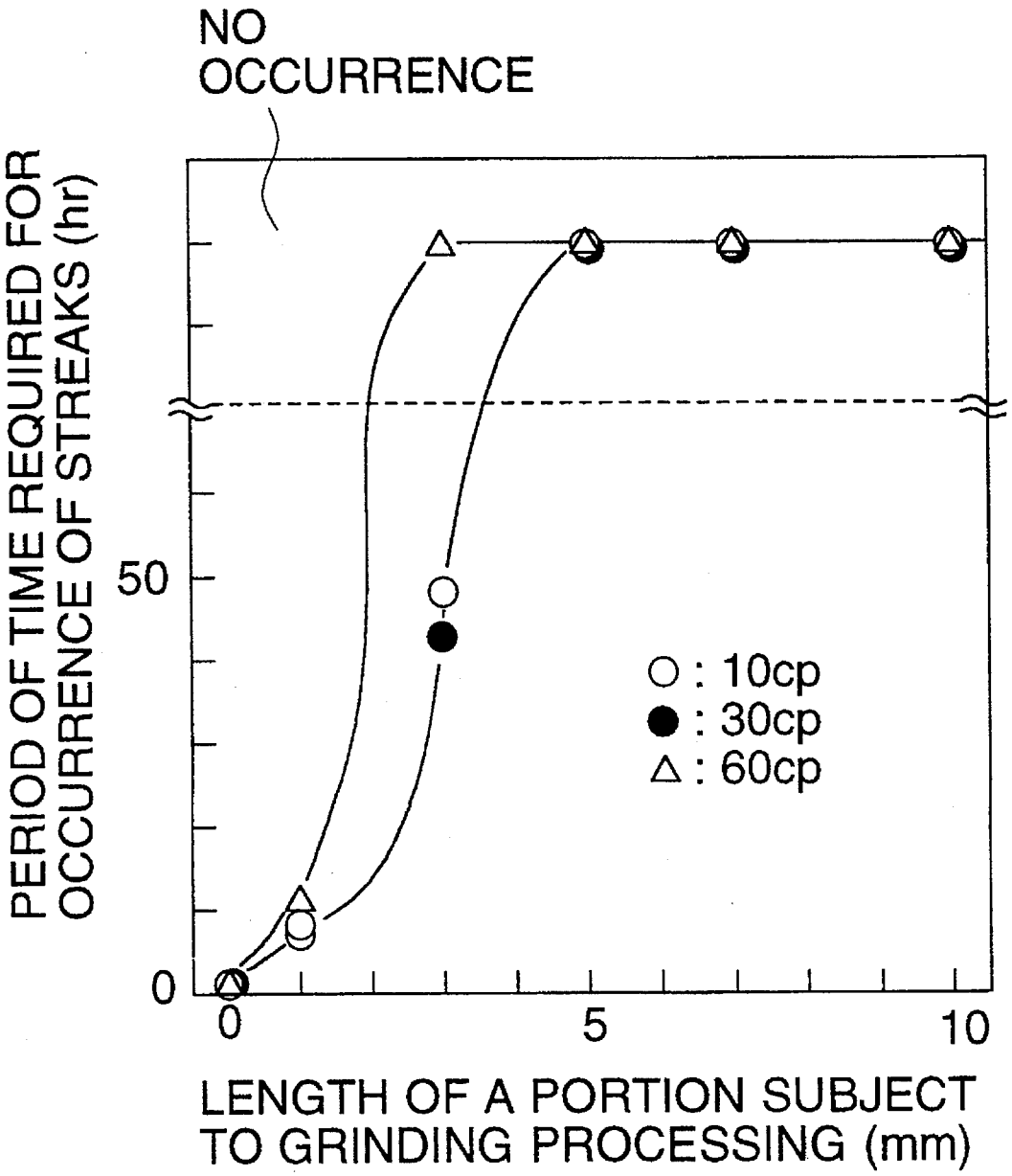
FIG. 4 is a graph showing the relationship of the grinding distance of the slit portion and the time in which streaks do not yet occur.

The results are shown in Table 1 and in FIG. 4.

TABLE 1

| | | Period of time required for occurrence of streaks with respect to viscosity of each coating solution | | | |
|---|---|---|---|---|---|
| Case | $L_1$ (mm) | 10 | 30 | 60 | |
| 6 | 1 | 7 | 9 | 12 | Present invention |
| 7 | 3 | 42 | 47 | no occurrence | Present invention |
| 8 | 5 | no occurrence | no occurrence | no occurrence | Present invention |
| 9 | 7 | no occurrence | no occurrence | no occurrence | Present invention |
| 10 | 10 | no occurrence | no occurrence | no occurrence | Present invention |
| 5 | 0 | 1 | 1 | 2 | Blank |

A grinding distance $L_1$ not smaller than 1 mm is preferable for the apparatus. When the surface was ground to a grinding distance of 5 mm, the viscosity did not affect the processing, and streak defects were not caused.

Accordingly, a grinding distance $L_1$ not smaller than 5 mm is more preferable.

EXAMPLE 3

(Coating solution)

Under layer coating solution: an anion surface active agent of 0.1 g is included per coating solution of 1 liter. Silver halide emulsion including gelatin of 3 wt % is used. The following quick-acting hardener is added by the in-line addition before coating. The wet thickness of the coating layer: 50 μm Viscosity: 10 cp at 35° C.

Upper layer coating solution: gelatin aqueous solution of 5 wt % including an anion surface active agent of 0.2 g per coating solution of 1 liter.

Conditions in which cohesive materials are easily generated were set in this experiment by utilizing the quick-acting hardener.

Chemical 2

Quick-acting Hardener

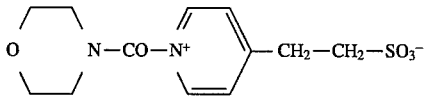

(Coating conditions)

The same support as was used in Example 1. Coating speed: 150 m/min Wet thickness of the layer: 40 μm Viscosity: 20 cp at 35° C.

(Coating apparatus)

A curtain coater for 2 layers shown in FIG. 1(*b*) was used.

coater having cutout portions as shown in FIGS. 2(*b*), (*c*), (*d*), (*e*) on a portion of the slit was used.

These cutout portions, having grinding distance $L_1$, were smoothed by electropolishing to a surface roughness Ra=0.01 μm.

Figure 5:
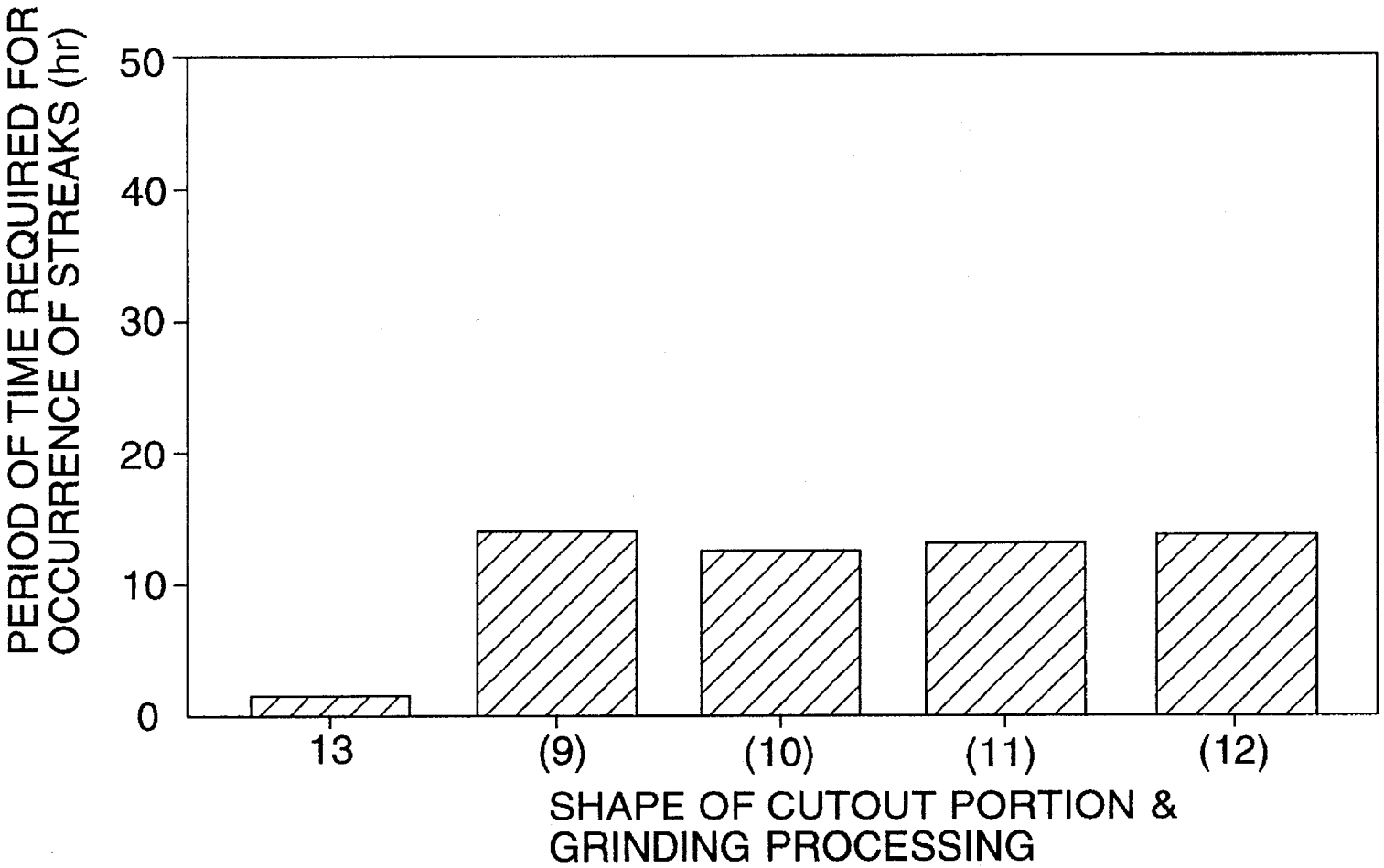
FIG. 5 is a graph showing the relationship of the shape of cutout portions and the time in which streaks do not yet occur.

The evaluation method is the same as that used in Example 1. The results are shown in the following table and FIG. 5.

| Case | Shape of cutout portion | Time (hours) |
|---|---|---|
| 9 | (b) a = 3 mm b = 1 mm | 15 |
| 10 | (c) c = 2 mm d = 4 mm | 13 |

-continued

| Case | Shape of cutout portion | Time (hours) |
|---|---|---|
| 11 | (d) e = 2 mm f = 2 mm | 14 |
| 12 | (e) g = 2 mm h = 4 mm i = 2 mm j = 2 mm | 15 |
| 13 | (b) no electropolishing | 1 |

From these results, the period of time required for the occurrence of the streak defects is prolonged to about 14 hours without relation to the shape of the cutout portion.

EXAMPLE 4

This example was carried out using the apparatus, in which the distance of the grinding portion of the slit is further extended by 5 mm to the inside of the slit ($L_2$), under the same condition as that of Example 3.

Example 4 was evaluated in the same way as Example 3. As a result, no streak defects were caused for more than 70 hours except in the case of no grinding.

According to the present invention, a coating apparatus can be provided in which: the adherence of the cohesive materials and foreign matter at the slit and the cutout portions is repressed; and the streak defects caused by the adherence can be prevented for a long period of time.

What is claimed is:

1. An apparatus for coating a web with a coating solution supplied to a coating head, the coating head comprising:

a coating section to coat the web with the coating solution; and a feed section including slit wall members forming a slit therebetween, the slit wall members having an inside surface to form an inside of the slit and an exit end to form an exit of the slit, wherein the coating solution is fed from the inside of the slit through the exit of the slit to the coating section, and wherein the inside surface of the slit wall members is finished at least 1 mm to 5 mm in distance from the exit end of the slit wall members so as to have a center line mean roughness not larger than 0.1 μm.

2. The apparatus of claim 1, wherein the center line mean roughness is not larger than 0.05 μm.

3. The apparatus of claim 2, wherein the center line mean roughness is not larger than 0.03 μm.

4. The apparatus of claim 1, wherein a cut-out portion to reduce pressure of the coating solution is provided, the cut-out portion opening at the coating section and having an inside edge delimiting the exit end of the slit wall members, the finished inside surface of the slit wall members extending from the inside edge of the cut-out portion.

* * * * *